United States Patent [19]

Davies et al.

[11] 4,300,999

[45] Nov. 17, 1981

[54] GAS OIL PURIFICATION

[75] Inventors: Haydn S. Davies, Solihull; James H. Garstang, Knowle; Cyril Timmins, Solihull, all of England

[73] Assignee: British Gas Corporation, London, England

[21] Appl. No.: 115,661

[22] Filed: Jan. 28, 1980

[30] Foreign Application Priority Data

Mar. 8, 1979 [GB] United Kingdom ..... 08212/79

[51] Int. Cl.[3] ..... C10G 45/08; C10G 49/22

[52] U.S. Cl. ..... 208/212; 48/214 A; 208/216 R; 208/217

[58] Field of Search ..... 208/212, 57, 89, 99, 208/208–217; 423/230

[56] References Cited

U.S. PATENT DOCUMENTS

| | | | |
|---|---|---|---|
| 3,551,124 | 12/1970 | Iwaki et al. | 208/212 X |
| 3,598,535 | 8/1971 | Wennerberg | 208/212 X |
| 3,660,276 | 5/1972 | Lacey | 208/212 |
| 3,694,350 | 9/1972 | Wennerberg | 208/212 |

*Primary Examiner*—Delbert E. Gantz
*Assistant Examiner*—G. E. Schmitkons
*Attorney, Agent, or Firm*—Larson and Taylor

[57] ABSTRACT

Hydrocarbon oils, particularly oils which have a high boiling temperature, are treated to remove organic sulphur compounds by subjecting a mixture of a hydrogenating gas, e.g. a gas containing at least 90% v/v hydrogen and is substantially free from carbon oxides, and partially vaporized oil to a hydrogenation reaction over a known hydrogenation catalyst and thereafter passing the resulting liquid/vapor mixture which also contains hydrogen sulphide over zinc oxide, thereby to remove the hydrogen sulphide.

7 Claims, 1 Drawing Figure

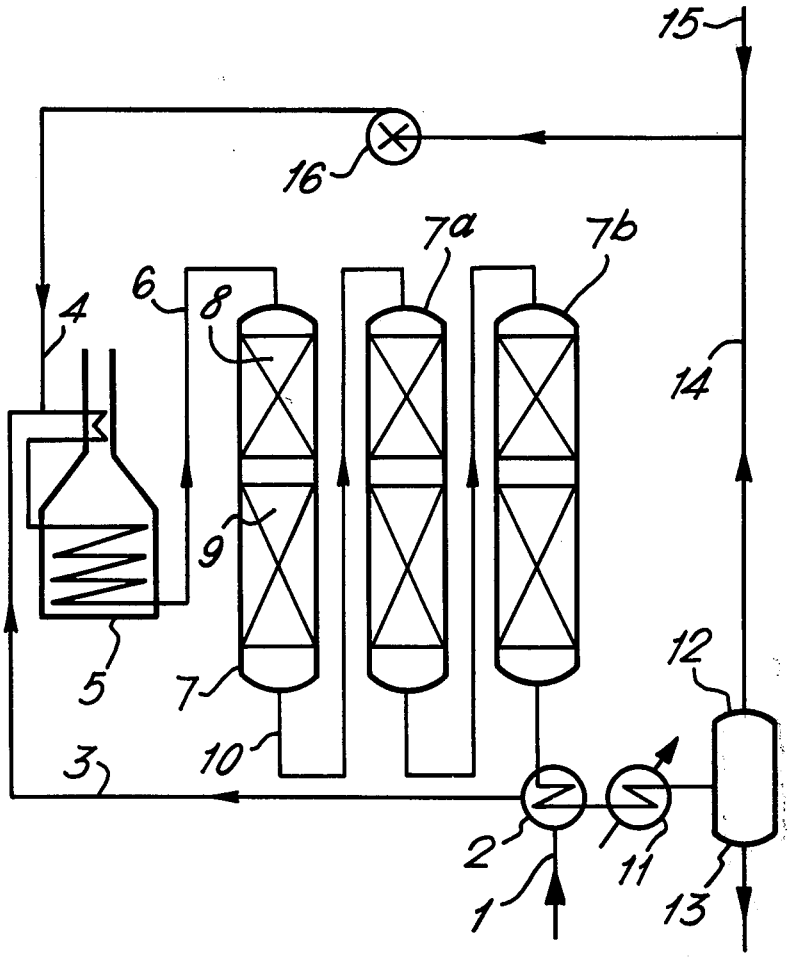
15
16
7a
7b
6
8
4
14
9
5
7
12
3
10
2
11
1
13

GAS OIL PURIFICATION

This invention relates to hydrocarbon processing and, in particular, to the hydrotreatment of hydrocarbon oils to remove sulphur compounds.

Hydrocarbon products from the refining of crude petroleum are hydrotreated commercially for a variety of reasons, examples of which are improvement of colour and viscosity and the removal of organically combined nitrogen and sulphur. Removal of nitrogen and sulphur is carried out for two principal reasons: the reduction of atmospheric pollutants in fuel oils and the prevention of catalyst poisoning when the hydrocarbon products are subjected to further treatment by a catalytic process. Feedstocks for steam-reforming processes, such as the CRG process used in the manufacture of Substitute Natural Gas (SNG) and other fuel gases, for example, are normally purified from sulphur compounds to less than 0.2 ppm (wt) before they are admitted to the catalytic stages in which they react with steam.

Conventional hydrotreatment involves contacting the hydrocarbon product with hydrogen in the presence of a cobalt-molybdenum, nickel-molybdenum or other suitable catalyst at elevated temperature and pressure such that organically combined nitrogen and sulphur are hydrogenated to ammonia and hydrogen sulphide. Simple physical means, such as washing and stripping, are then used to remove the ammonia and hydrogen sulphide formed. This combination of a hydrogenation stage followed by a stripping stage is commonly called hydrofining. The lighter petroleum fractions can readily be hydrofined to sulphur levels below 1 ppm (wt). Heavier fractions such as gas oil, which are more difficult to purify, could be hydrofined to sulphur levels of about 20 ppm (wt), it is believed, but are not known to be purified to this extent for any commercial purpose.

An alternative to washing and stripping, commonly adopted as a means of removing the hydrogen sulphide formed in the hydrogenation stage when feedstocks are purified for use in steam-reforming processes, is absorption in a bed of zinc oxide. In this application, both catalytic hydrogenation and absorption of hydrogen sulphide are carried out under pressure in the vapour phase and the purified hydrocarbon vapour is then mixed with steam and taken to the gasification stage. As with hydrofining, this hydrotreatment process readily allows the lighter petroleum fractions to be purified to very low sulphur levels. Fractions such as gas oil, however, when they have been vaporised, are at sufficiently high temperatures for undesirable side reactions to occur—for example, decomposition of the hydrocarbons, giving rise to carbon deposition, methanation of carbon oxides present in the hydrogenating gas and catalyst deactivation.

From its inception, one aspect of the development of the CRG process, as with others like it, has been to extend the range of feedstocks from the lighter to the heavier fractions with higher final boiling points. Whatever other obstacles might need to be overcome to adapt such processes for use with a heavier feedstock, the prime requirement is that the feedstock can be adequately purified from sulphur compounds so that catalyst poisoning is reduced to an acceptable level. The conventional hydrofining process, though it could be used to remove a substantial part of the sulphur-containing impurities of a fraction such as gas oil, has not sufficed to meet this requirement. Nor can the vapour-phase combination of catalytic hydrogenation with absorption of hydrogen sulphide by zinc oxide be used without detriment to catalyst life as described above: the progression to higher boiling feedstocks, coinciding with the use of higher pressures, which also raise the boiling point to the feedstock, gives vapour temperatures above the maximum for satisfactory operation.

An object of this invention is to provide for the purification of the heavier petroleum fractions to an extent such as is necessary if they are to be used as feedstocks in catalytic steam-reforming processes.

According to this invention there is provided a process for the removal of sulphur compounds from hydrocarbon oils having a final boiling point within the range 200°–550° C., which process comprises the steps of:

(i) Partly vaporising the oil;

(ii) Contacting the partly vapourised oil and a hydrogen-containing gas with a hydrogenation catalyst at a temperature within the range 300°–420° C. thereby to hydrogenate the sulphur compounds to hydrogen sulphide; and (iii) Absorbing the hydrogen sulphide produced by passing the partly vaporised oil, hydrogen-containing gas and hydrogen over zinc oxide.

References herein to "organic sulphur compounds" include simple compounds of carbon and sulphur such as carbonyl sulphide (COS) and carbon disulphide ($CS_2$).

Processing a feedstock that has been only partly vaporised, using conditions which maintain some part of it in the liquid phase, is an operation carried out in what have become known as 'trickle bed reactors'. This practice is accepted in hydrotreatment technology for the hydrogenation stage but is is not known to use zinc oxide in such a situation. Indeed, since manufacturers of zinc oxide absorbent specifically warn against condensation of steam as affecting the strength of their product, one might well be inclined not to allow it to come into contact with a liquid. Nevertheless, the sulphur absorption performance of zinc oxide has surprisingly been found not to be adversely affected by the two-phase conditions in a trickle bed reactor.

Although the process of the invention is itself capable of purifying feedstocks of high sulphur content if a sufficient number of hydrogenation and absorption stages are used, in general it is preferred for economic reasons to use conventional hydrotreatment technology to remove much of the sulphur. Purification of the feedstock to not more than about 400 ppm (wt) of sulphur, removing the hydrogen sulphide formed by physical means, reduces the quantity of zinc oxide that has to be used and increases the interval between recharging two vessels. The process is thus most advantageously exploited in the fine purification of feedstocks to very low sulphur levels.

Catalysts for use in the hydrogenation stage(s) are commercially available and include, for example, Ketjenfine 153 and Shell 324 (containing nickel and molybdenum) and Cyanamid Aero HDS 86 (containing nickel and tungsten). Some hydrocracking catalysts, e.g. Harshaw 0402T, Laporte MD1 and Harshaw 4301E have also been found to be satisfactory.

The proportions of hydrogen-containing gas to be used, expressed as scf (standard cubic feet) of hydrogen in the gas per lb of feedstock), depends on the nature of the feedstocks. With the lighter gas oils or heavier kerosines, the requirement for hydrogen can be as low as 1 scf/lb under the most favourable reaction conditions but as the sulphur content and final boiling point of the feedstock increase more hydrogen-containing gas must be provided. In general, however, it is preferred to use a hydrogen/feedstock ratio within the range 1–20 scf/lb. A further preferrence is for a gas containing at least 90% of hydrogen and free from carbon oxides.

The operating pressure of the process preferably lies within the range 100–1500 lb/ins$^2$.

Although the process of the invention provides for a number of hydrogenation and absorption stages in series, it may be that the tail gas oil mixture requires further treatment to remove the final amounts of sulphur compounds but that the amount of sulphur compounds is insufficient to warrant provision of a further hydrogenation and absorption stage. In cases such as this the tail gas oil mixture may be subjected to a final "clean-up" by passage through a combined hydrogenation/absorption stage. For example the tail gas-oil mixture may be cooled to a temperature of less than 250 C. and passed through a bed comprising a mixture of the oxides of zinc and copper or comprising a reduced nickel-alumina catalyst such as those conventionally used in steam reforming.

The invention will now be described with reference to the accompanying drawing, which is a diagramatic flow sheet of the process.

Referring to the drawing, the feedstock to be purified, which may already have been hydrofined to remove much of the sulphur, is admitted under pressure through line 1 and passed through heat exchanger 2. It is then taken along the line 3 to be mixed with hydrogen-containing gas, also under pressure and conveyed through line 4, and the mixture is passed through heater 5, where the feedstock partly vaporises. The partly vaporised feedstock, mixed with hydrogen-containing gas, is taken through line 6 to vessel 7, which contains a bed of hydrogenation catalyst 8 and zinc oxide 9. When it is more convenient to do so, separate vessels may be used to contain beds 8 and 9. Hot liquid feedstock percolates through both beds of solid material in the presence of feedstock vapour and hydrogen-containing gas i.e. both 8 and 9 are trickle beds.

Assuming further purification to be necessary, though it is conceivable that in some circumstances it might not be, the mixture leaving vessel 7 is taken through line 10 to a similar vessel 7(*a*) and thence, if necessary, to another similar vessel 7(*b*). Each of these vessels contains the same or a similar arrangement of catalyst and zinc oxide trickle beds and in each the same processes of hydrogenation of sulphur compounds and absorption of hydrogen sulphide are effected. Three such vessels are shown in the drawing but it is to be understood that more or fewer may be used, depending on how readily the desired degree of purification can be achieved. The quantities of catalyst and absorbent in each stage need not be the same.

The feedstock adequately purified, the mixture leaving the final vessel is cooled in heat exchangers 2 and 11, thus condensing the vaporised hydrocarbon oil. Purified liquid is separated from excess hydrogen containing gas in vessel 12 and is removed through line 13. The excess hydrogen-containing gas is drawn off through line 14, additional gas to make up for that used being supplied through line 15, and is recycled through compressor 16 to line 4.

The following examples illustrate the application or the process to the purification of commercially available gas oils obtained from two of the major oil companies.

EXAMPLE 1

A gas oil, as received from the refinery, had the specification shown in Table 1.

TABLE 1

| | |
|---|---|
| Sulphur content, ppm (wt) | 1450 |
| Aromatics content, percent (wt) | 24.5 |
| Aliphatics content, percent (wt) | 74.5 |
| Density (15° C.), kg/liter | 0.836 |
| Average molecular weight | 240 |
| Initial boiling point, °C. | 159 |
| Final boiling point, °C. | 374 |

This oil was first prepurified in an experimental pilot plant to reduce its sulphur content to a level such as might be expected to result from hydrotreatment by the conventional hydrofining process. A feedstock for use in the process of the present invention was thereby obtained having in the specification shown in Table 2.

TABLE 2

| | |
|---|---|
| Sulphur content, ppm (wt) | 20 |
| Aromatics content, percent (wt) | 29.1 |
| Aliphatics content, percent (wt) | 70.9 |
| Density (15° C.), kg/liter | 0.836 |
| Average molecular weight | 220 |
| Initial boiling point, °C. | 81 |
| Final boiling point, °C. | 362 |

The process arrangement here exemplified comprised only one stage of catalytic hydrogenation followed by absorption of hydrogen sulphide with zinc oxide. That is to say, referring to the drawing, that vessels 7(*a*) and 7(*b*) were bypassed; the effluent from vessel 7 was taken from line 10, through a line not shown, to heat exchanger 2 instead of to the inlet of vessel 7(*a*). A cobalt-molybdenum catalyst was used. Over a period of operation lasting 415 hours, the following conditions were maintained to give the average sulphur contents shown in Table 3.

TABLE 3

| | CoMo | ZnO |
|---|---|---|
| Temperature, °C. | 381 | 375 |
| Pressure (gauge) lb/in$^2$ | 650 | 650 |
| Hydrogen/oil, scf/lb | 4.9 | 4.9 |
| Space velocity, lb/ft$^2$h | 51 | 51 |
| Organic S in product, ppm (wt) | 0.2 | 0.2 |

EXAMPLE 2

The same gas oil was used in this example as in Example 1 but it was prepurified to a lesser extent. The feedstock prepared for use in the process had the specification shown in Table 4.

TABLE 4

| | |
|---|---|
| Sulphur content, ppm (wt) | 94 |
| Aromatics content, percent (wt) | 30.0 |
| Aliphatics content, percent (wt) | 70.0 |
| Density (15° C.), kg/liter | 0.841 |
| Average molecular weight | 210 |
| Initial boiling point, °C. | 108 |
| Final Boiling point, °C. | 369 |

In order to achieve a satisfactory degree of purification at the higher sulphur content, it was necessary to make use of two stages of catalytic hydrogenation followed by absorption of hydrogen sulphide. Referring again to the drawing, the process arrangement in this example included vessel 7(*a*) and only vessel 7(*b*) was bypassed. An increase in the hydrogen/oil ratio was also necessary. The same charges of cobalt molybdenum catalyst and zinc oxide continued in use in the first stage and identical materials were used in the second. Over a period of operation lasting 591 hours, the following conditions were maintained to give the average sulphur contents shown in Table 5.

TABLE 5

| | 1st Stage | | 2nd Stage | |
|---|---|---|---|---|
| | CoMo | ZnO | CoMo | ZnO |
| Temperature, ° C. | 381 | 375 | 364 | 383 |
| Pressure (gauge), lb/in$^2$ | 650 | 650 | 650 | 650 |
| Hydrogen/oil, scf/lb | 6.3 | 6.3 | 6.3 | 6.3 |
| Space velocity, lb/ft$^2$h | 49.5 | 49.5 | 49.5 | 49.5 |
| Organic S in product, ppm (wt %) | 0.8 | 0.5 | 0.1 | 0.1 |

EXAMPLE 3

A commercially available gas oil, as received from the refinery, had the specification shown in Table 6.

TABLE 6

| | |
|---|---|
| Sulphur content, ppm (wt) | 3220 |
| Aromatics content, percent (wt) | 30 |
| Aliphatics content, percent (wt) | 70 |
| Density (15° C.), kg/liter | 0.845 |
| Average molecular weight | 220 |
| Initial boiling point, °C. | 195 |
| Final boiling point, °C. | 345 |

A prepurification treatment was first employed to reduce the sulphur content of this oil, giving a feedstock with the specification shown in Table 7.

TABLE 7

| | |
|---|---|
| Sulphur content, ppm (wt) | 100 |
| Density (15° C.) kg/liter | 0.836 |
| Average molecular weight | 210 |
| Initial boiling point °C. | 94 |
| Final boiling point, °C. | 349 |

In this example, where the process of the invention was operated at a lower pressure and space velocity than in the preceding two examples, all three stages of catalytic hydrogenation followed by absorption of hydrogen sulphide, as shown in the drawing, were employed. The same charges of cobalt molybdenum catalyst continued in use in the first oxide charges, again of the same material previously used, came into use in all three stages. The hydrogen/oil ratio was reduced to the level used in Example 1. Over a period of operation lasting 330 hours, the following conditions were maintained to give the average sulphur contents shown in Table 8.

TABLE 8

| | 1st Stage | | 2nd Stage | | 3rd Stage | |
|---|---|---|---|---|---|---|
| | CoMo | ZnO | CoMo | ZnO | CoMo | ZnO |
| Temperature, °C. | 380 | 371 | 373 | 377 | 374 | 361 |
| Pressure (gauge), on/in$^2$ | 400 | 400 | 400 | 400 | 400 | 400 |
| Hydrogen/oil, scf /lb | 4.7 | 4.7 | 4.7 | 4.7 | 4.7 | 4.7 |

TABLE 8-continued

| | 1st Stage | | 2nd Stage | | 3rd Stage | |
|---|---|---|---|---|---|---|
| | CoMo | ZnO | CoMo | ZnO | CoMo | ZnO |
| Space velocity, lb/ft$^2$h | 27 | 27 | 27 | 27 | 27 | 27 |
| Organic S in product, ppm (wt) | 2.2 | 2.1 | 0.4 | 0.3 | 0.4 | 0.2 |

EXAMPLE 4

A further 644 hours' operation, in which the chief difference from Example 3 was the higher pressure, the same feedstock and materials continuing in use, gave the average sulphur contents shown in Table 9.

TABLE 9

| | 1st Stage | | 2nd Stage | | 3rd Stage | |
|---|---|---|---|---|---|---|
| | CoMo | ZnO | CoMo | ZnO | CoMo | ZnO |
| Temperature, °C. | 381 | 375 | 376 | 349 | 375 | 367 |
| Pressure (gauge), lb/in$^2$ | 450 | 450 | 450 | 450 | 450 | 450 |
| Hydrogen/oil, scf /lb | 4.7 | 4.7 | 4.7 | 4.7 | 4.7 | 4.7 |
| Space velocity, lb/ft$^2$h | 27 | 27 | 27 | 27 | 27 | 27 |
| Organic S in product, ppm (wt) | 2.1 | 1.5 | 0.2 | 0.3 | 0.2 | 0.2 |

EXAMPLE 5

The same gas oil was used in this example as in Example 3 but it was prepurified to a lesser extent. Except that its sulphur content was 409 ppm wt, the feedstock prepared for use in the process had the specification shown in Table 7.

A further 148 hours' operation with slight changes in the conditions of Example 4 and with the same charges of catalyst and zinc oxide gave the average sulphur contents shown in Table 10.

TABLE 10

| | 1st stage | | 2nd Stage | | 3rd Stage | |
|---|---|---|---|---|---|---|
| | CoMo | ZnO | CoMo | ZnO | CoMo | ZnO |
| Temperature, °C. | 380 | 371 | 374 | 382 | 382 | 372 |
| Pressure (gauge), lb/in$^2$ | 450 | 450 | 450 | 450 | 450 | 450 |
| Hydrogen/oil, scf /lb | 5.1 | 5.1 | 5.1 | 5.1 | 5.1 | 5.1 |
| Space velocity, lb/ft$^2$h | 25 | 25 | 25 | 25 | 25 | 25 |
| Organic S in product, ppm (wt) | 4.4 | 3.9 | 0.7 | 0.4 | 0.4 | 0.2 |

We claim:

1. A process for the removal of organic sulphur compounds from hydrocarbon oils having a final boiling point within the range of 200°–550° C., which process comprises the steps of:

(i) partly vaporising the oil, (ii) contacting the resulting mixture of partly vaporised oil and unvaporized liquid oil, and a hydrogen-containing gas with a hydrogenation catalyst at a temperature within the range of 300°–420° C., thereby to hydrogenate the organic sulphur compounds to hydrogen sulphide, and (iii) absorbing the hydrogen sulphide thus produced by passing the vaporized oil, liquid oil, hydrogen-containing gas and hydrogen sulphide over zinc oxide, said steps (i), (ii), and (iii) being conducted under conditions which maintain part of the hydrocarbon oil in the liquid phase.

2. A process as claimed in claim 1, wherein a plurality of hydrogenation and absorption stages are used in series.

3. A process as claimed in claim 1 wherein the hydrogenation catalyst comprises nickel, cobalt or molybdenum as the active catalytic ingredient.

4. A process as claimed in claim 1, wherein the operating pressure is from 100 to 1500 psi.

5. A process as claimed in claim 1, wherein the hydrogenating gas contains at least 90% by volume of hydrogen and is substantially free from carbon oxides.

6. A process as claimed in claim 1, wherein the ratio of hydrogenating gas to oil is from 1 to 20 scf/lb.

7. A process as claimed in claim 1, wherein the outlet mixture from stage (iii) is passed through a further bed comprising a mixture of copper and zinc oxides or nickel alumina at a temperature of less than 250° C.

* * * * *